US005865051A

United States Patent [19]

Otzen et al.

[11] Patent Number: 5,865,051

[45] Date of Patent: Feb. 2, 1999

[54] PROCEDURE AND APPARATUS FOR THE OPTIMIZED MANUFACTURE OF COIL SPRINGS ON AUTOMATIC SPRING WINDING MACHINES

[75] Inventors: Uwe Otzen, Rottweil; Hans-Jürgen Schorcht; Mathias Weiss, both of Ilmenau, all of Germany

[73] Assignee: Wafios Maschinenfabrik GmbH & Co. Kommanditgesellschaft, Reutlingen/Wurtt, Germany

[21] Appl. No.: 849,604

[22] PCT Filed: Dec. 6, 1995

[86] PCT No.: PCT/DE95/01733

§ 371 Date: Jun. 3, 1997

§ 102(e) Date: Jun. 3, 1997

[87] PCT Pub. No.: WO96/17701

PCT Pub. Date: Jun. 13, 1996

[30] Foreign Application Priority Data

Dec. 7, 1994 [DE] Germany ..... 44 43 503.07
Apr. 19, 1995 [DE] Germany ..... 195 14 486.4

[51] Int. Cl.[6] ..... B21B 37/00

[52] U.S. Cl. ..... 72/17.3; 72/18.6; 72/19.5; 72/19.7; 72/135; 72/183; 226/21; 226/137; 242/418.1

[58] Field of Search ..... 72/8.3, 8.9, 11.1, 72/11.6, 12.6, 12.7, 12.8, 17.3, 18.6, 19.5, 19.6, 19.7, 135, 136, 137, 138, 140, 142, 143, 144, 183, 205; 29/896.92; 140/92.3, 92.4, 92.7; 226/15, 18, 21, 137, 138; 242/416, 418, 418.1

[56] References Cited

U.S. PATENT DOCUMENTS 4,362,038 12/1982 Katahira et al. ..... 72/137
4,422,583 12/1983 Maxner et al. ..... 242/45
4,491,003 1/1985 Messick .
4,669,289 6/1987 Itaya ..... 72/20.4
4,774,824 10/1988 Ritter et al. ..... 72/160
4,918,958 4/1990 Glomb et al. ..... 72/12.7

(List continued on next page.)

FOREIGN PATENT DOCUMENTS 02 55 507 A2 7/1987 European Pat. Off. .
1815640-A 6/1970 Germany .
84 166 4/1971 Germany .
2 126 695 5/1974 Germany .

(List continued on next page.)

OTHER PUBLICATIONS

Industrieanzeiger, Nr. 26 v.29.3.1985/107.Jg. S.30.
N.N.: Verschiedene MeBverfahren der Durchhangregelung. In: Bander, Bleche, Rohre Nov. 1974, Bd. 15, S.455–458.
JP 55–153633 A., In: Patents Abstracts of Japan, M–55, Feb. 14, 1981, No. 25.

(List continued on next page.)

*Primary Examiner*—Joseph J. Hail, III
*Assistant Examiner*—Ed Tolan
*Attorney, Agent, or Firm*—Renner, Otto, Boisselle & Sklar, P.L.L.

[57] ABSTRACT

Procedure and apparatus for the optimized manufacture of coil springs on automatic spring winding machines. It is the object of the present invention to offer both a procedure and an apparatus by which even in case of fluctuating values of the wire parameters high accuracies during the spring manufacture are guaranteed and simultaneously the scrap is minimized. The solution to this problem is that prior to the winding the wire parameters are determined and the measuring results are used directly for the adjustment of the position of the winding pins or winding rollers and/or the pitch wedge, and that the wire between the uncoiling device and the guiding assembly forms a loop whereby the lateral deflection of this wire loop is measured by a recognition unit and the uncoiling device carries out an additional movement controlled by the recognition unit. The invention is suitable for continuous inspection and correction of errors occurring on spring wires for the optimized manufacture of coil springs on automatic spring winding machines.

14 Claims, 6 Drawing Sheets

U.S. PATENT DOCUMENTS

| | | | |
|---|---|---|---|
| 5,240,194 | 8/1993 | Noirot et al. | 242/45 |
| 5,243,746 | 9/1993 | Shinichi . | |
| 5,392,977 | 2/1995 | Kato | 72/8.6 |
| 5,454,151 | 10/1995 | Bogucki-Land et al. | 242/418.1 |
| 5,477,715 | 12/1995 | Kempf | 72/135 |

FOREIGN PATENT DOCUMENTS

| | | |
|---|---|---|
| 35 38 944 A1 | 7/1986 | Germany . |
| 34 26 191 C2 | 6/1994 | Germany . |
| 86/04837 | 8/1986 | WIPO . |

OTHER PUBLICATIONS

Blum, Thomas, u.a.: Stand der Technik in der Federnfertigung. In: Draht 45, 1994, 7/8, 452–460.

Wagner, Ralf: Lean–Operating. In: Drahtwelt Mar. 93, S. 18–20.

PROCEDURE AND APPARATUS FOR THE OPTIMIZED MANUFACTURE OF COIL SPRINGS ON AUTOMATIC SPRING WINDING MACHINES

DESCRIPTION

The invention relates to a procedure and an apparatus for continuous inspection and correction of errors occurring on spring wires destinated for optimized manufacture of coil springs on automatic spring winding machines, whereby a wire is uncoiled by an uncoiling device in which a spool or coil is provided, and fed into a forming apparatus by means of a separate feeding device containing winding pins or rollers.

Coil springs must meet steadily increasing accuracy requirements of industrial users with regard to their compliance with constructionally fixed spring parameters, especially the characteristic curve of the spring. The reasons for this are in particular the increasing requirements for machines and apparatuses in which coil springs are used, as well as the growing degree of automation in the manufacture of machines and apparatuses with the trend to limit the work to components with narrow tolerances.

The spring wire as basic material is subject to fluctuations depending on material, geometry, and processing technology. Said fluctuations become visible by deviations of the wire diameter, the mechanical strength properties or the material parameters from their nominal values and by twists as a result of elastic torsion stress. In addition, a decisive role is played by deviations resulting from the plastic-elastic deformation behaviour of the spring wire having its origin mostly in previous manufacturing stages.

The abovementioned fluctuations cause considerable deviations of the parameters of the cold-formed coil spring from the fixed constructional data, the effects of which can be seen in deviations of the spring characteristic curve from the desired characteristic curve.

In particular, the fluctuating thickness of the wire diameter causes inclination changes of the spring characteristic curve, i.e. fluctuations of the spring rate, and the different elastic torsion stresses in the wire coil cause length fluctuations of the produced spring and thus parallel displacements of the spring characteristic curve.

Inevitably, this leads to scrap during spring production which may be considerably high when the springs are of small dimensions and must meet high accuracy requirements. Since said scrap in most cases is stated not before the spring is completed, considerable economic losses arise. Moreover, the necessary supplementary requirements of material and energy are additional threats to the environment.

The state of the art discloses machines for spring production provided with intake rollers, mechanically or electrically controlled winding pins or rollers, pitch tools and forming tools. First they were developed mainly with the aim to produce highest possible numbers of pieces and to guarantee the conversion to the production of springs with different dimensions and forms at justifiable costs.

The state of the art further discloses machines with supervisory and quality assurance systems in which the spring length is measured or inspected mechanically, optically, capacitively or by induction change.

Further, other systems are known which recognize and sort out scrap springs with the help of said measuring or inspection facilities and which automatically correct the control of the automatic spring winding machine. As a rule, this is carried out based on methods for statistical process control. Other existing variations furnish error signals to the operator via dialog systems when the finished springs have deviations, so that the operator has to intervene by correcting the control. Further, other systems are known which interrupt the manufacturing process after a certain number of scrap springs produced in succession.

JP 55-153 633 (A) discloses a configuration designed to prevent torsional stress of a steel rope during unwinding from a coil by a controlled turn of the unwinding coil. Hereby said turn of the unwinding coil is scanned by a sensor which controls the turning movement of a fixed run-off roller over which the rope is guided. This configuration can not be used to determine and to influence the torsional stresses impressed in a rigid wire.

DE 35 38 944 describes a machine for the production of coil springs by winding, by which springs with a constantly changeable pitch can be produced. It is foreseen that the spring manufacturing machine contains an electronic control circuit. A data storing unit stores data displaying preselected spring parameters, like for example pitch, length, and diameter. During forming of a spring the respective preselected parameter of the spring is monitored, and a signal showing the monitored parameter is created. The electronically stored data and the monitoring signal are compared with each other. The spring production can then be changed according to this comparison for the manufacture of a spring with the preselected parameter. This machine makes it possible to freely change the parameters of the coil springs in order to meet the preselected spring requirements. The dimensions of the spring can be changed during the actual manufacturing process of the coil springs so that springs with pitches can be produced which are changing continuously over the length of the spring.

This is a manufacturing procedure in which the springs are formed by a winding process around a mandrel. This kind of manufacture allows no change of the winding diameter. In addition, single wire rods in a finite length are fed, so that no continuous influencing of the wire parameters is possible. Here it is possible to determine and to change the spring winding parameters, but it is not possible to compensate tolerances of the spring material parameters during the continuous operation of an automatized spring winding production.

It is the disadvantage of the known spring winding machines and procedures that they detect any fluctuation of the parameters of the basic spring wire material not before the production is completed.

It is the object of this invention to find both a procedure and an apparatus of the kind stated at the beginning which guarantee high accuracies for the spring manufacture even in case of fluctuating wire parameter values, and which simultaneously minimize the scrap.

The solution according to this invention is a procedure and an apparatus as described in claims 1, 2, and 4. The subclaims describe advantageous embodiments.

The procedure according to this invention and the apparatus according to this invention excel by a number of advantages.

Both the procedure and the apparatus according to this invention make it possible to compensate the elastic torsion stresses of the spring wire, what is particularly important for the use of springy wire types. Said torsion stress is not visible from outside, since after this manufacturing procedure the hard drawn wire is coiled under tension. The torsion stresses are released when this compulsion is taken away from the spring wire. They manifest themselves by spreading or turning down of the wire loops and lead to length fluctuations of the produced spring and thus to the above-mentioned parallel displacement of the spring characteristic curve.

Measuring of the spring wire diameter in one or two planes can be effected by several procedures. Measuring in two planes makes it possible to recognize deviations of the wire diameter and to pass them on to the process control. Besides electric contact or non-contact sensors, optical sensors are advantageous with photometric evaluation of the changes.

Correction of the wire diameter fluctuations is particularly important for quenched and tempered spring wires. The tensions of these wires generated during drawing are reduced by the final hardening process carried out at over 860° C., but in exchange, in the interior of the furnace the wire will be stretched with a tapering effect even at the slightest hindrance of the wire run-off reel. So here fluctuations of the wire diameter are considerably more distinctive than in case of patented drawn wires and rustproof wires.

By combinating the winding tools with load-sensing instruments it becomes possible to measure the forming forces of the spring winding and to draw conclusions from their evaluation for the changes of the spring parameters, and to include these changes into the machine control.

Another special design includes an E or G module measuring device. Said measuring device consists of rollers causing a slight elastic deformation of the wire by defined values, meanwhile they measure the necessary deformation forces.

Since the starting condition of the wire is determined already prior to the forming process and is taken into account in the control of the winding tools, the scrap can be considerably reduced.

In addition, the forming result can be constantly supervised and the desired/actual deviation can be returned to the tool position over a regulator. This leads to considerable reductions of the costs for wages, material, and energy, and to reduced expenses for material recycling and to a reduction of additional enviromental threats.

Both the procedure and the apparatus according to the invention can be advantageously applied to the production of new automatic spring manufacturing machines, whereby their application is not restricted to automatic coil spring winding machines, but is also suitable for other machines for spring production. They are also suitable for subsequent installation in already existing numerically controlled automatic spring winding machines so that as many as possible spring manufacturers can benefit from the invention without fundamental renewal of their machinery and with low financial expenditure.

With the help of the gathered measuring results it is further possible to sort the springs according to different quality classes.

In the following, the invention will be explained in detail by way of example in a preferred embodiment with reference to the attached drawings in which FIG. 1 shows a schematic view of the feeding device with loose loop;

Figure 1:
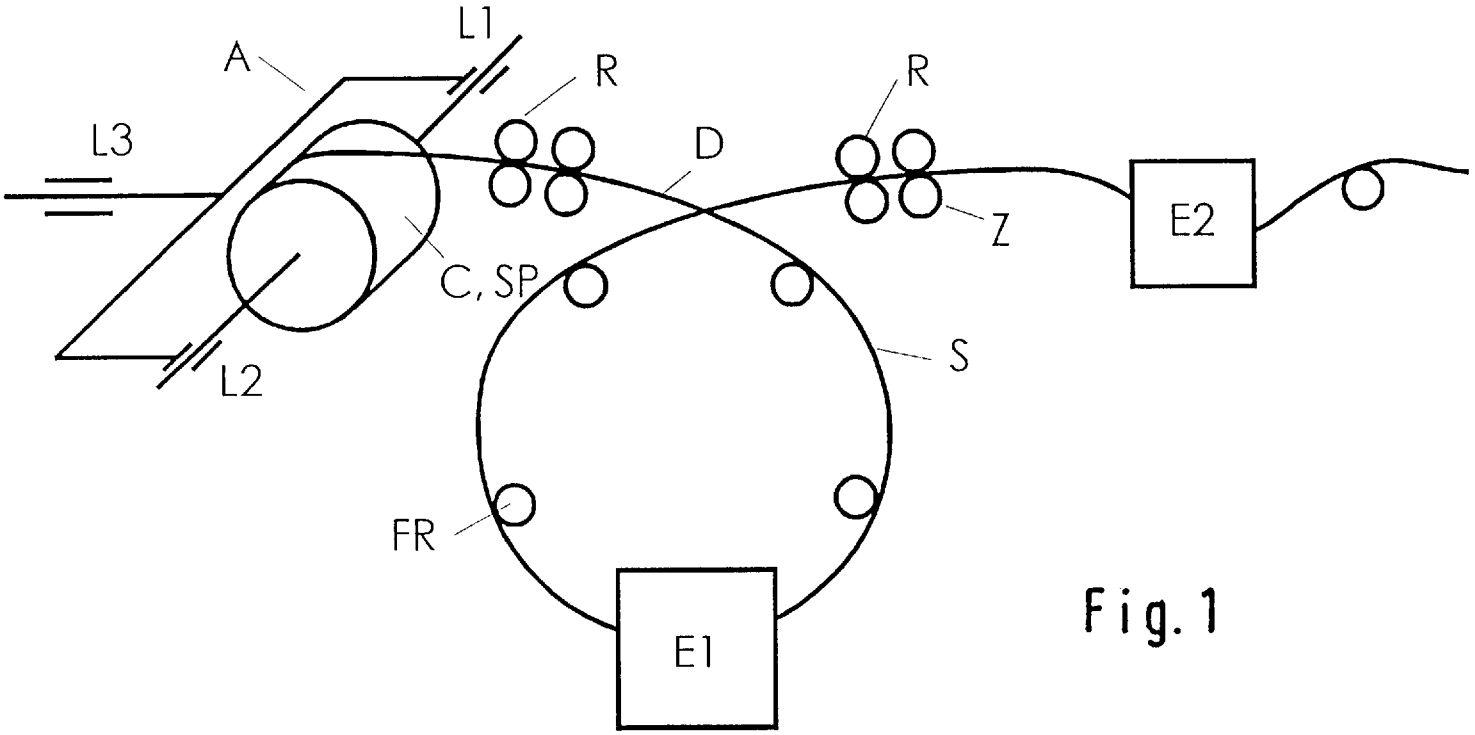

In FIG. 1 the wire is pulled down over the wire feed rollers R from a coil C sitting on a reel. Said reel is driven by a not shown controlled drive. For the purpose of uncoiling, said reel with coil C is provided in bearings L1 and L2. The complete uncoiling device A is pivotable by means of bearing L3. The axis of bearing L3 coincides with the direction of the pulled-off wire D. The wire is fed by the guiding assembly Z over the recognition unit E towards the wire feeding device of the machine. Under the effect of gravity the wire forms a loop S between the guiding assembly Z and the uncoiling device A. The length of said loop S is controlled by the movements of the uncoiling device A and the guiding assembly Z in such a way that it maintains an approximatively constant diameter. The formation of the loop is supported by the guide rollers FR. When wire D has no torsion stress, wire loop S is hanging vertically downwards. When the wire has torsion stress, the wire loop S leaves its vertical position. The degree of this deflection is determined by the recognition unit E1 and leads over a separate control unit to a turn of the uncoiling device A in bearing L3 so that the torsion stress is eliminated and can have no effect on the subsequent operations. A second recognition unit E2 is provided between machine and wire loop S. It determines the actual wire need for the spring manufacture and controls the drives of guide rollers R and bearings L1, L2 depending on the corresponding wire need. In the example shown in the drawing the slack of the wire concerned is determined for this purpose.

Figure 2:
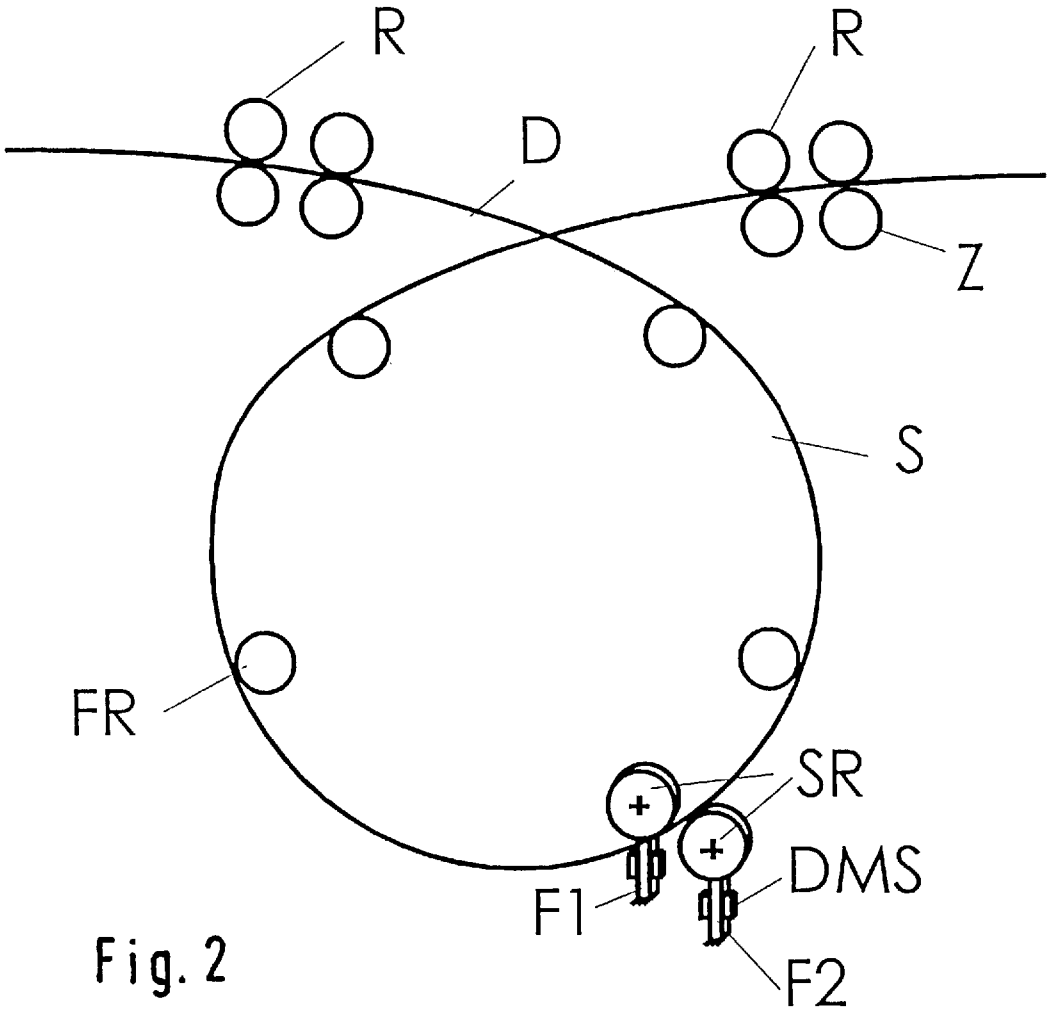
FIG. 2 shows an embodiment according to FIG. 1 in which wire strain gauges are used as sensors.

FIG. 2 shows a possibility to arrange the sensors. In this case two sensor rollers SR are located at the wire loop S which are fixed to the rack by springs F1 and F2. If wire D is under torsion stress, this latter causes a deflection of wire loop S and thus also a deflection of springs F1 and F2. The springs F1 and F2 are equipped with wire strain gauges DMS by which the deflection is measured. With the help of said wire strain gauges DMS a size value for the deflection of the wire loop S can be determined and the necessary swivel movement of the uncoiling device A can be controlled.

Besides the installation of wire strain gauges, different other sensors can be used for the recognition unit. The sensors can on the one hand determine the deformation of a plastic element, like this is shown in FIG. 2, and on the other hand measure the displacement of an element by a path-measuring system. In the most simple case stops on both sides are sufficient which signalize contact when they are touched.

Figure 3:
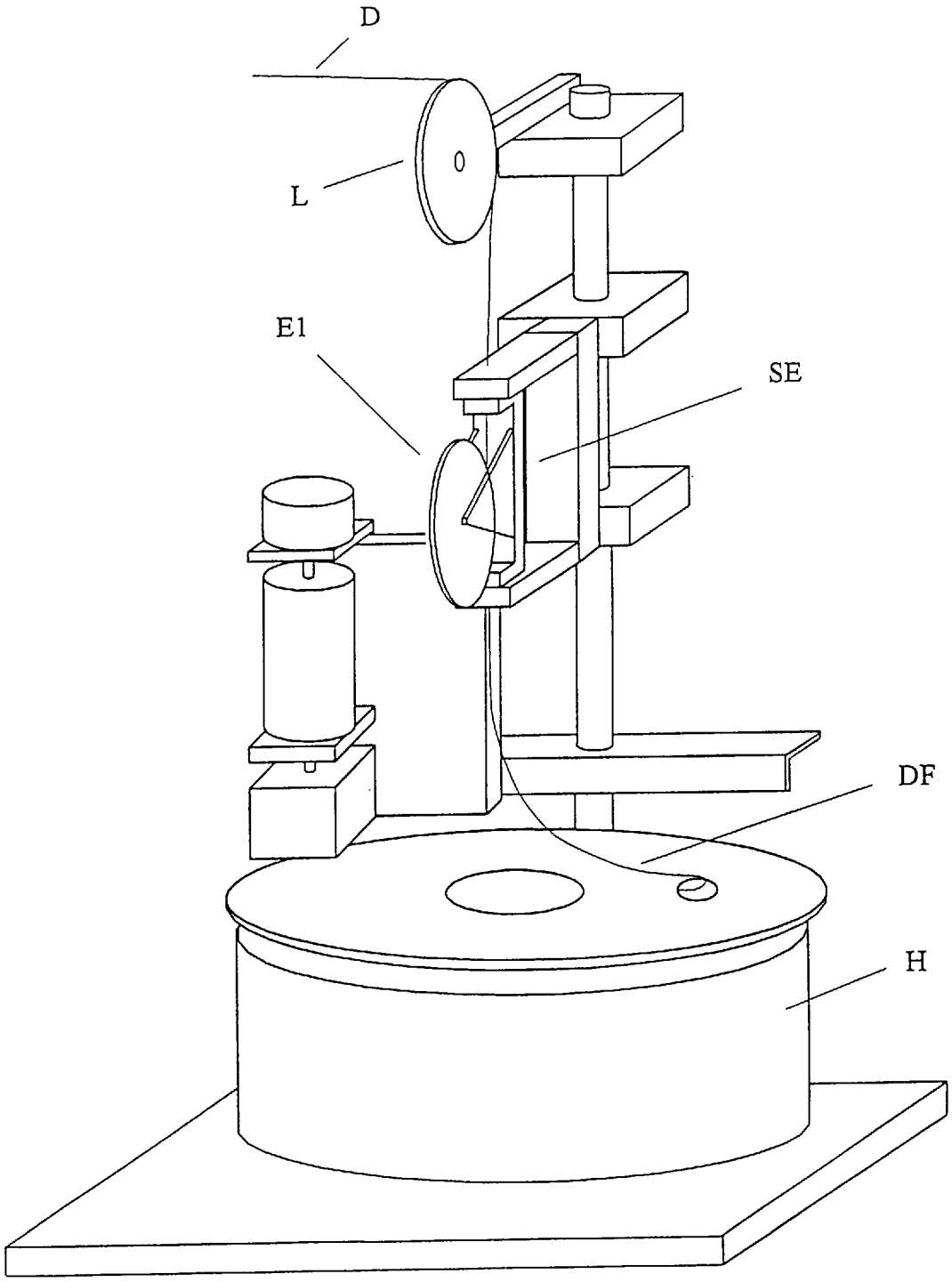
FIG. 3 shows a feeding device with rotatable wire pull-off guide.

FIG. 3 shows a feeding device with pivoted wire pull-off guide DF. Here the torsion stressed wire is pulled down from a reel H under tension. The torsion stressed wire is guided within the realization unit E1 around a pivoted wheel in a wire loop acting as torsion indicator. For this purpose said wheel is so installed that it can make a swivel movement around an axis vertical to its wheel axis, in addition to its turn around the wheel axis caused by the pull-off movement of the wire. Said swivel movement depends on the torsion stress contained in the fed wire. The recognition unit E1 is connected with a sensor SE which indicates the deflection of the recognition unit E1. Therefore, any torsion stress between the fixed guiding wheel L and the wire pull-off guide DF leads to a deflection of recognition unit E1 and is indicated by the sensor. When torsion-free wire is uncoiled, the reel cup must carry out a 360° turn to uncoil one complete wire loop. The torsion stresses are eliminated by introduction of a defined relative movement between the reel and the controllably pivoted wire pull-off guide DF so that a twist-free wire is fed to the winding machine. Particularly advantageous is here, that this arrangement allows a quick and precise execution of the controllable additional movement of the wire pull-off guide DF. This is obtained especially by the fact that the movement of the wire pull-off guide DF which has only very little mass is separated from the movement of the reel H. The reel H, too, which has much mass, must effect an additional movement in order to guarantee a continuous wire outlet. The additionally pivoted wire pull-off guide DF allows separation of these two movements so that it is not necessary to accelerate the reel H with strong forces and consequently high wear of the moving parts.

Figure 4:
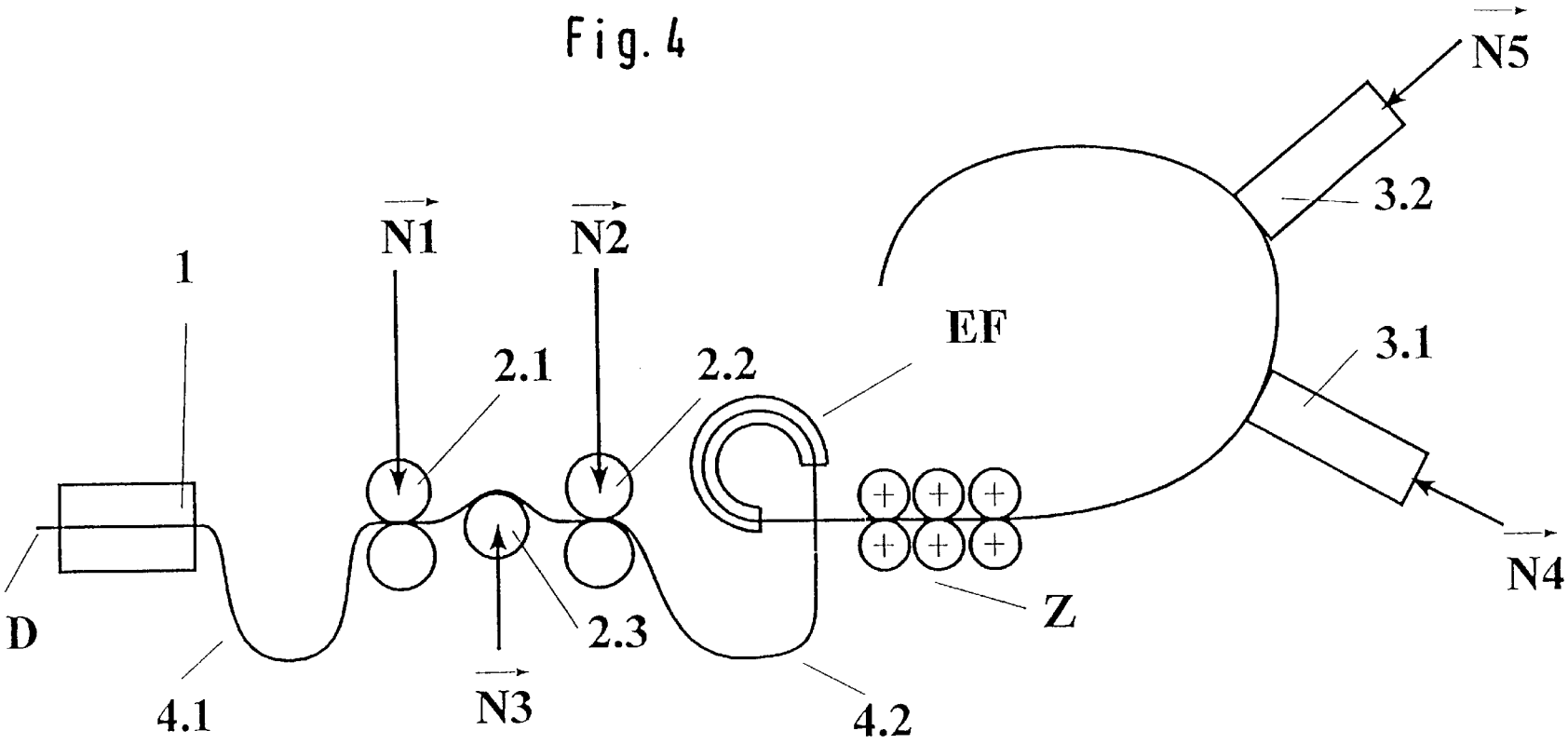
FIG. 4 shows a schematic view of the apparatus according to the invention.

FIG. 4 shows a schematic illustration of the apparatus according to the invention. For the production of a coil spring the wire is first led past a wire diameter measuring device 1 by which the actual diameter of the spring wire is determined. Thereafter the wire passes into the measuring device where the E or G module are determined. This measuring device consists of rollers 2. Among said rollers at least the roller 2.3 is adjustable in vertical direction to the roller axis, roller pair 2.2 is driven, and roller pair 2.1 is running freely. The abovementioned adjustment causes an elastic deformation of the wire by defined values. The rollers are connected to sensors which continuously measure the bearing loads N1, N2, and N3. Said bearing loads depend on the material properties of the spring wire and allow the determination of the E module. By this it becomes possible to determine the G module for the respective actual state. In order to carry out the measurement independent from the influences of the machine function, loops 4.1 and 4.2 are provided. The deformation properties of the wire to be processed can be recognized and suitable reactions can be started. Such reactions can be for example an alarm signal or the release of appropriate adjustment movements of the forming tools. When the wire has passed through this device, it goes over the intake guide EF into the guiding assembly Z and then into the forming device. The adjustment of the winding pins for the wire thickness depending control of the spring diameter is carried out on the basis of the following formula:

$$D_{mk} = D_{mo} \times \sqrt[3]{\left(\frac{d_{ist}}{d_o}\right)^4}$$

Explanations $D_{mk}$=mean spring diameter after correction $D_{mo}$=desired value of mean spring diameter $d_{ist}$=determined actual value of the wire diameter $d_o$=desired value (standard value)

The intake guide EF leads the wire D in a defined bow towards the forming device. Said intake guide EF is effective when the wire is bent and guarantees definite winding conditions. The intake guide EF can consist of a curved pipe or be formed by an arrangement of rollers.

With regard to the forming device, FIG. 4 shows the winding pins 3.1 and 3.2 which are electrically adjustable. Another adjusting device allows adjustment of the pitch wedge so that all geometric parameters of the spring to be produced can be influenced. The winding pins 3.1 and 3.2 are provided with force sensors by which the winding forces N4 and N5 are continuously determined. By this also changes of the wire forming properties are detected and transmitted to the process control for evaluation.

Figure 5:
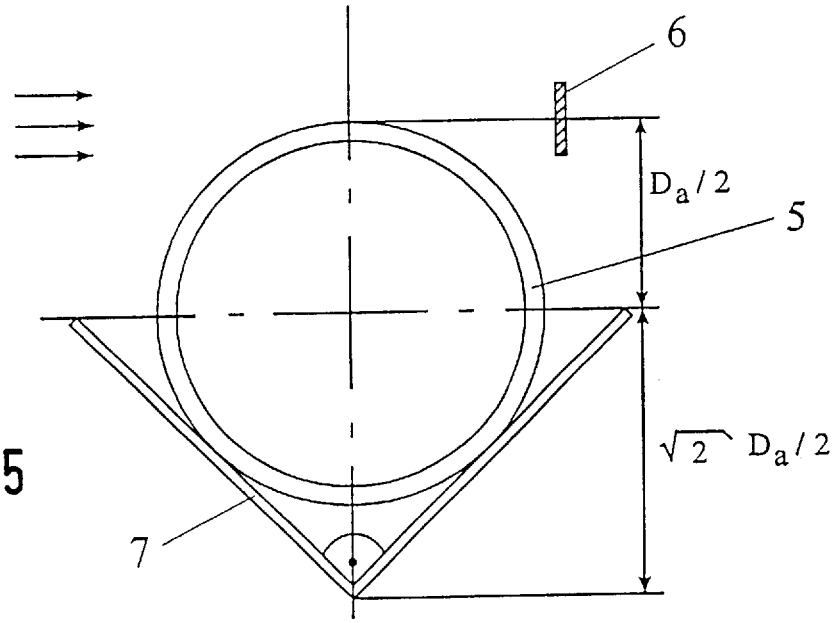
FIGS. 5 and 6 show the arrangement for the determination of the spring diameter.
Figure 6:
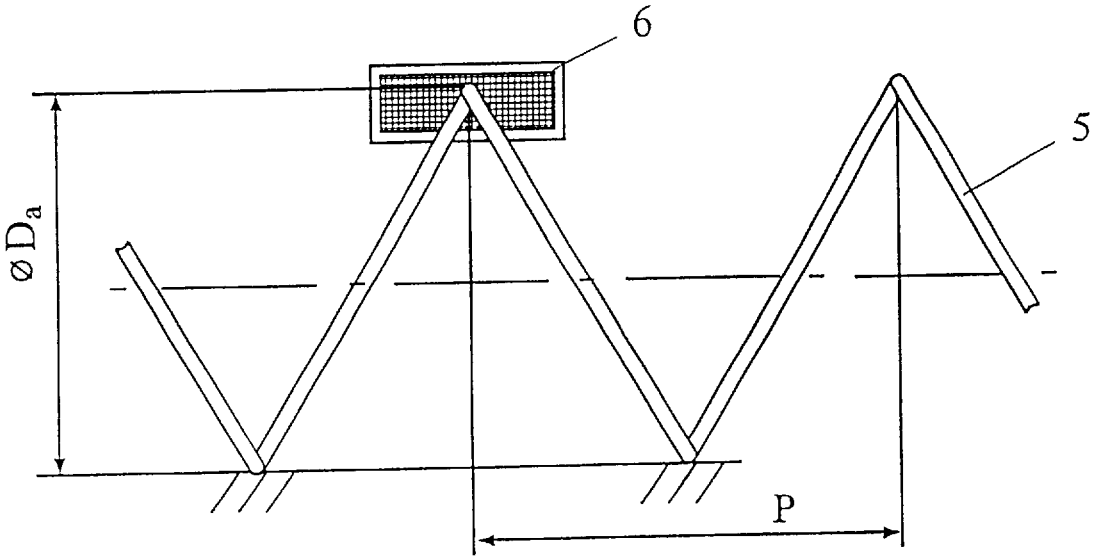

FIGS. 5 and 6 show an arrangement with which the outside spring diameter $D_a$ and the pitch P can be determined after the winding. Regarding the appropriate measuring device for this, different solutions are possible. As shown in the example, the spring diameter is determined at the spring 5 with the help of a CCD matrix 6. Hereby the spring 5 is in definite touch with the V groove 7. Fluctuations of the spring diameter can also be stated in a known manner by the silhouette procedure or the scanning principle with optical measuring devices.

Figure 7:
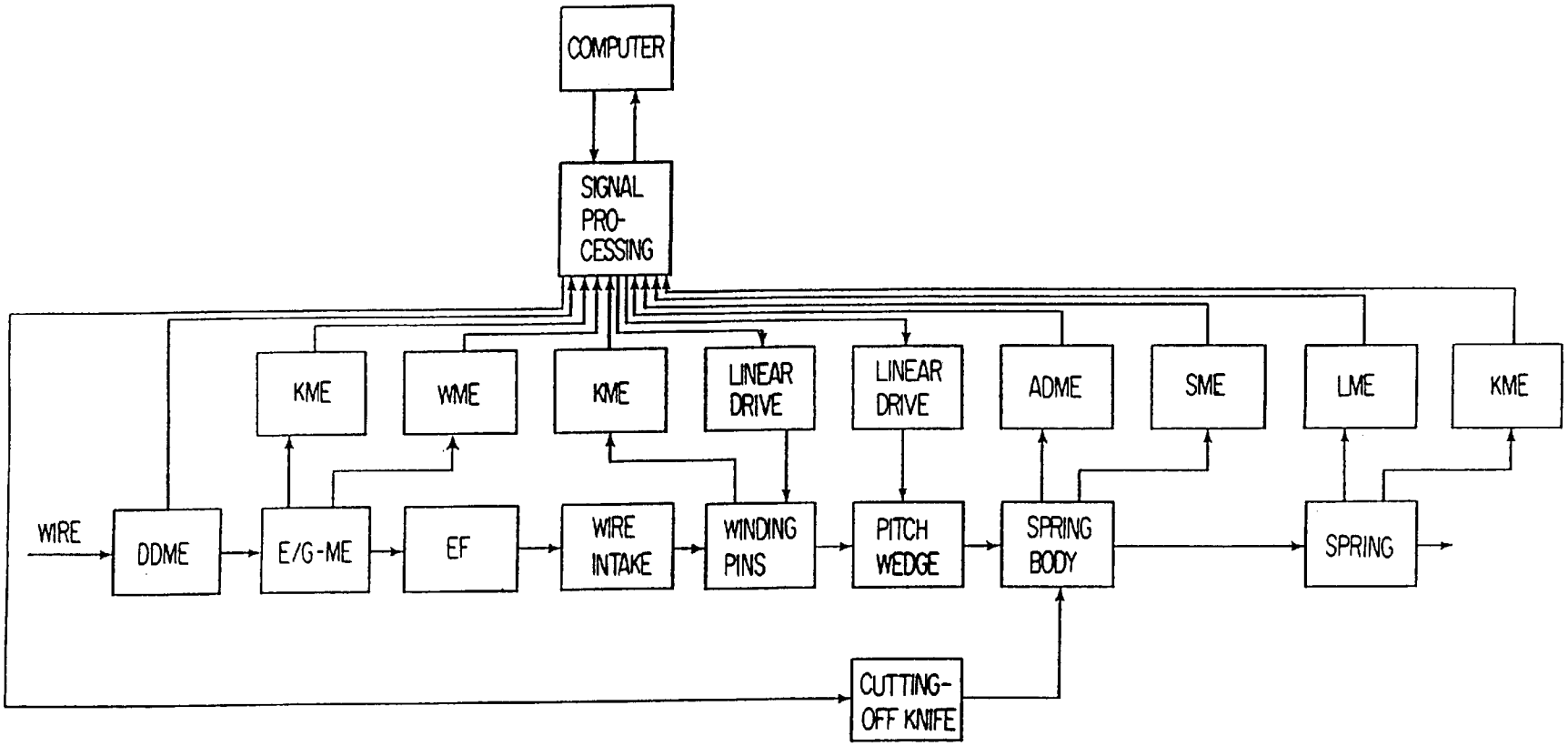
FIG. 7 shows the linkage of the different components with the help of a bloc diagram.

FIG. 7 is a schematic illustration of the linkage of the structural components. The required adjusting movements are triggered by a computer connected with each of the measuring stations of the machine via signal processing. Hereby the wire is drawn into the device by the wire intake. Prior to this it passes through the wire diameter measuring device DDME. The wire intake is in a known manner connected to a path-measuring device from which a signal for the length of the wire to be processed is gathered. This measuring device is not shown on the drawing. Prior to the wire intake the apparatus according to the invention has an E or G module measuring device E/G-ME with a force measuring device KME and a path-measuring device WME with which the deformation of the wire and the necessary force are determined. Based on both the determined force and deformation values, the actual values for the E module of the wire can be determined. The G module can be determined with the help of the E module. When the wire has passed through the measuring device, it is fed to the intake device and thus to the forming device in which the winding pins 3 and the pitch wedge are contained. Winding pins 3 and pitch wedge each are connected with linear drives with which the actually necessary positions of these elements are approached. In addition, the winding pins 3 are connected with a force measuring device KME which transmits information on the measured forming forces to the signal processing for evaluation. When the wire has passed through the forming device it is shaped as a spring. The dimensions of this spring body are determined by the outside diameter measuring device ADME and the pitch measuring device SME. The spring body is cut off in the required length by means of a cutting-off knife controlled by the signal processing. The thus obtained spring is evaluated by a length measuring device LME and a force measuring device KME in a way that the characteristic curve of the spring is determined. The so gathered actual data are also transmitted to the signal processing. The measurement of the spring length by the length measuring device LME and of the spring forces by the force measuring device KME and consequently the determination of the spring characteristic curve can also be carried out before the spring is cut-off.

Due to this arrangement it is possible to measure deviations of the spring wire diameter and to realize appropriate compensations as well as their effects on the pitch of the spring characteristic curves by controlled change of other spring parameters, preferrably of the spring diameter. Since the actual value of the sliding module is also measured, it is possible to gather a number of further correction information for the maintenance of the spring characteristic curve and to take them into account for the adjustment movements.

List of Reference Numbers

1 wire diameter measuring device

2 rollers

3 winding pins
4 wire loops
5 spring
6 CCD matrix
7 V groove
N1, N2, N3 reaction forces
N4, N5 winding forces
F spring
P pitch
$D_a$ outside spring diameter
MS wire strain gauge
DDME wire diameter measuring device
ADME outside diameter measuring device
SME pitch measuring device
LME length measuring device
KME force measuring device
WME angle measuring device
E/G-ME E or G module measuring device
z guiding assembly
L guiding wheel
H reel
S wire loop
DF wire pull-off guide
EF intake guide
C coil
SP spool
D wire
A uncoiling device
R rollers
L1, L2, L3 bearings
FR guide rollers
SR sensor rollers

We claim:

1. A procedure for winding coil springs out of wire which is uncoiled by an uncoiling device and fed by means of a separate guiding assembly to a forming device for winding the wire in helical shape, wherein prior to the winding at least one wire parameter is determined and the measuring results are directly used for controlling the forming device, and based on the deviation of the wire diameter from its desired value, determined prior to winding, the forming device is controlled in such a way that the spring diameter is $$D_{mk} = D_{mo} \times \sqrt[3]{\left[\frac{d_{ist}}{d_o}\right]^4}$$

whereby $D_{mk}$ signifies mean spring diameter after the correction $D_o$ signifies desired value of the mean spring diameter $d_{ist}$ signifies mean actual value of the wire diameter and $d_o$ signifies desired value (standard value) of the wire diameter.

2. A procedure according to claim 1, wherein the uncoiled wire has elastic torsional stresses before winding, the wire between the uncoiling device and the guiding assembly is guided in a loop whereby any lateral deflection of the wire loop is measured by a recognition unit; and wherein the uncoiling device in addition to the rotation movement for uncoiling the wire makes another movement the extent and the direction of which are controlled by the recognition unit in such a way that the torsional stresses are compensated.

3. A procedure for winding coil springs out of wire which is uncoiled by an uncoiling device and fed by means of a separate guiding assembly to a forming device for winding the wire in helical shape, wherein prior to the winding at least one wire parameter is determined and the measuring results are directly used for controlling the forming device, and wherein as said wire parameter at least one of the modulus of elasticity and the modulus of transverse elasticity of the wire to be wound is determined.

4. A procedure according to claim 3, wherein the uncoiled wire has elastic torsional stresses before winding, the wire between the uncoiling device and the guiding assembly is guided in a loop whereby any lateral deflection of the wire loop is measured by a recognition unit; and wherein the uncoiling device in addition to the rotation movement for uncoiling the wire makes another movement the extent and the direction of which are controlled by the recognition unit in such a way that the torsional stresses are compensated.

5. A procedure for winding coil springs out of wire which is uncoiled by an uncoiling device and fed by means of a separate guiding assembly to a forming device for winding the wire in helical shape, wherein prior to the winding at least one wire parameter is determined and the measuring results are directly used for controlling the forming device, and wherein the uncoiled wire has elastic torsional stresses before winding, the wire between the uncoiling device and the guiding assembly is guided in a loop whereby any lateral deflection of the wire loop is measured by a recognition unit; and wherein the uncoiling device in addition to the rotation movement for uncoiling the wire makes another movement the extent and the direction of which are controlled by the recognition unit in such a way that the torsional stresses are compensated.

6. An apparatus for winding coil springs out of wire which is uncoiled by an uncoiling device and fed by means of a separate guiding assembly to a forming device for winding the wire in helical shape, wherein at least one winding parameter is determined and the measuring results are directly used for controlling the forming device, said apparatus comprising the uncoiling device for uncoiling the wire from a spool or a coil, and the guiding assembly for feeding the wire towards a forming device for the winding of said wire, characterized by the formation of a loop of the wire between the uncoiling device and the guiding assembly, by a recognition unit located next to said loop for measuring a lateral deflection of the wire loop, and by a wire pull-off guide of the uncoiling device arranged rotatably around the spool or coil axis and controlled by the recognition unit to carry out an additional movement.

7. An apparatus according to claim 6, wherein the recognition unit comprises a roller which takes up the wire loop and which is additionally swivel-mounted on an axis parallel to the wire guiding direction, as well as a sensor which produces a signal depending on the deflection of the roller swivelling about said axis.

8. An apparatus according to claim 6, wherein a wire diameter measuring device is provided between the uncoiling device and the guiding assembly.

9. An apparatus according to claim 6, wherein a measuring device for the determination of at least one of the modulus of elasticity and the modulus of transverse elasticity of the wire is provided between the uncoiling device and the guiding assembly.

10. An apparatus according to claim 9, wherein the measuring device has rollers which cause an elastic deformation of the wire by defined values whereby it measures deformation forces and deformation paths.

11. An apparatus according to claim 6, wherein force sensors for the determination of deformation forces created by winding pins or rollers of the forming device are provided at the winding pins or rollers.

12. An apparatus according to claim 6, wherein the forming device has one measuring device each for measuring an outside diameter of the spring and a pitch of the wound spring, respectively.

13. An apparatus according to claim 6, wherein an intake guide is provided between the uncoiling device and the guiding assembly and the wire is guided by said intake guide in a defined bow towards the forming device.

14. An apparatus for winding coil springs out of wire which is uncoiled by an uncoiling device and fed by means of a separate guiding assembly to a forming device for winding the wire in helical shape, wherein at least one winding parameter is determined and the measuring results are directly used for controlling the forming device, said apparatus comprising the uncoiling device for uncoiling the wire from a spool or a coil, and the guiding assembly for feeding the wire towards a forming device for the winding of said wire characterized by the formation of a loop of the wire between the uncoiling device and the guiding assembly, by a recognition unit located next to said loop for measuring a lateral deflection of the wire loop, and by a wire pull-off guide of the uncoiling device arranged rotatably around the spool or coil axis and controlled by the recognition unit to carry out an additional movement, and wherein the recognition unit comprises two sensors located on both sides of the wire loop that create signals when the wire loop is laterally deflected, the signals controlling a swivel movement of the rotatable uncoiling device around an axis parallel to the wire pull-off direction.

* * * * *